US008002541B2

(12) United States Patent
Neville et al.

(10) Patent No.: US 8,002,541 B2
(45) Date of Patent: Aug. 23, 2011

(54) COMBUSTION METHOD AND APPARATUS

(75) Inventors: Thomas B. Neville, Portola Valley, CA (US); John J. Nowakowski, Valley View, OH (US); Mark C. Hannum, Aurora, OH (US); Thomas F. Robertson, Medina Township, OH (US)

(73) Assignee: Fives North American Combustion, Inc., Cleveland, OH (US)

( * ) Notice: Subject to any disclaimer, the term of this patent is extended or adjusted under 35 U.S.C. 154(b) by 0 days.

(21) Appl. No.: 12/902,191

(22) Filed: Oct. 12, 2010

(65) Prior Publication Data

US 2011/0027731 A1 Feb. 3, 2011

Related U.S. Application Data

(60) Division of application No. 12/124,454, filed on May 21, 2008, now Pat. No. 7,837,462, which is a continuation of application No. 11/112,780, filed on Apr. 22, 2005, now Pat. No. 7,402,038.

(51) Int. Cl.
*F23C 5/00* (2006.01)

(52) U.S. Cl. ..... 431/174; 431/181; 431/182; 431/187

(58) Field of Classification Search ..... 431/12, 431/174, 8, 9, 115, 181, 182, 187, 350, 353
See application file for complete search history.

(56) References Cited

U.S. PATENT DOCUMENTS

2005/0053877 A1* 3/2005 Feese et al. ..... 431/10

* cited by examiner

*Primary Examiner* — Alfred Basichas
(74) *Attorney, Agent, or Firm* — Jones Day

(57) ABSTRACT

A burner has a port facing into a combustion chamber along an axis. A secondary fuel injector structure has secondary fuel injection ports that face into the combustion chamber at locations spaced radially outward from the burner port. A tertiary fuel injector structure has tertiary fuel injection ports that face into the combustion chamber in directions perpendicular to the axis at locations spaced axially downstream from the secondary fuel injection ports.

11 Claims, 3 Drawing Sheets

COMBUSTION METHOD AND APPARATUS

RELATED APPLICATIONS

This Application is a division of application Ser. No. 12/124,454, filed May 21, 2008, which is a continuation of application Ser. No. 11/112,780, filed Apr. 22, 2005.

TECHNICAL FIELD

This technology relates to a heating system in which combustion produces oxides of nitrogen (NOx), and specifically relates to a method and apparatus for suppressing the production of NOx.

BACKGROUND

Certain industrial processes, such as heating a load in a furnace or generating steam in a boiler, rely on heat produced by the combustion of fuel and oxidant in a combustion chamber. The fuel is typically natural gas. The oxidant is typically air, vitiated air, oxygen, or air enriched with oxygen. Combustion of the fuel and oxidant in the combustion zone causes NOx to result from the combination of oxygen and nitrogen. It may be desirable to suppress the production of NOx.

SUMMARY

The claimed invention provides a method and apparatus for delivering fuel and oxidant to a combustion chamber. To summarize, the method delivers fuel and oxidant to a combustion chamber at target rates that together have a target fuel-to-oxidant ratio by:

a) delivering the target rate of oxidant and a first partial target rate of fuel together in a fuel-lean primary reactant stream that is directed into the combustion chamber along an axis to define a primary combustion zone expanding radially outward along the axis;

b) simultaneously delivering a second partial target rate of fuel in second stage fuel streams that are injected into the combustion chamber at locations radially outward of the primary reactant stream to define a secondary combustion zone radially outward of the primary combustion zone; and c) simultaneously delivering the balance of the target rate of fuel at a third partial target rate in third stage fuel streams that are injected into the combustion chamber at locations within the primary reactant stream to define a tertiary combustion zone extending axially downstream from the primary combustion zone.

Summarized differently, the method delivers fuel and oxidant to a combustion chamber at target rates that together have a target fuel-to-oxidant ratio by:

a) delivering the target rate of oxidant and a first partial target rate of fuel together in a fuel-lean primary reactant stream that is directed into the combustion chamber through a primary port centered on an axis;

b) simultaneously delivering a second partial target rate of fuel in second stage fuel streams that are injected into the combustion chamber through secondary fuel injection ports spaced radially outward from the primary port; and c) simultaneously delivering the balance of the target rate of fuel at a third partial target rate in third stage fuel streams that are injected into the combustion chamber in directions perpendicular to the axis through tertiary fuel injection ports that are spaced axially downstream from the secondary fuel injection ports.

The apparatus can be summarized as including a structure defining a combustion chamber, a burner, a secondary fuel injector structure, and a tertiary fuel injector structure. The burner has a port facing into the combustion chamber along an axis. The secondary fuel injector structure has secondary fuel injection ports that face into the combustion chamber at locations spaced radially outward from the burner port. The tertiary fuel injector structure has tertiary fuel injection ports that face into the combustion chamber in directions perpendicular to the axis at locations spaced axially downstream from the secondary fuel injection ports.

DETAILED DESCRIPTION

Figure 1:
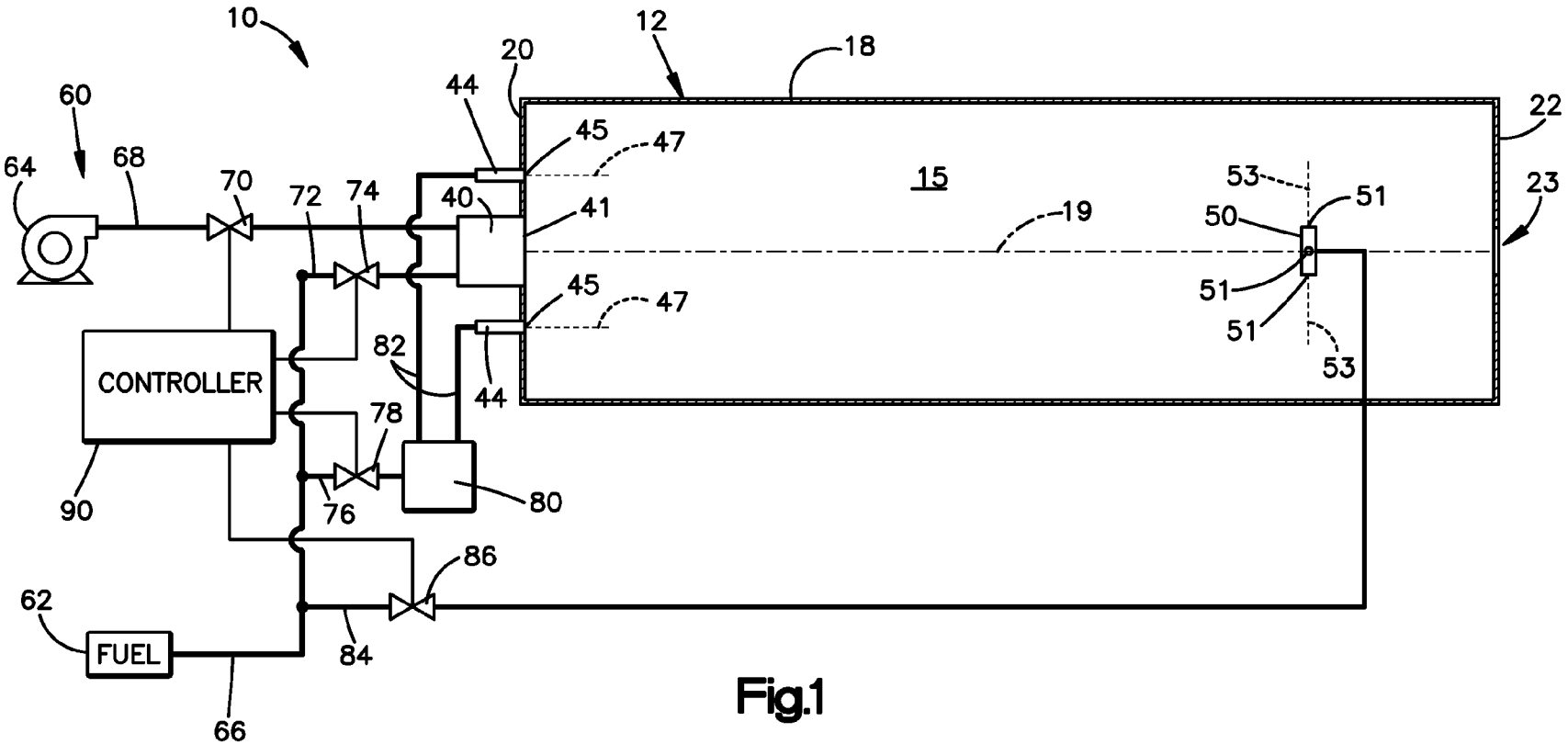
FIG. 1 is a schematic view of a heating system including a combustion chamber.

The structures shown schematically in the drawings can be operated in steps that are examples of the elements recited in the method claims, and have parts that are examples of the elements recited in the apparatus claims. The illustrated structures thus include examples of how a person of ordinary skill in the art can make and use the claimed invention. They are described here to meet the enablement and best mode requirements of the patent statute without imposing limitations that are not recited in the claims. The various parts of the illustrated structures, as shown, described and claimed, may be of either original and/or retrofitted construction as required to accomplish any particular implementation of the invention.

The structure 10 shown in FIG. 1 is a heating system for a low temperature boiler known as a steam generator. The parts of the heating system 10 that are shown schematically in FIG. 1 include a radiant heating structure 12. The radiant heating structure 12 encloses an elongated cylindrical combustion chamber 15, and has an elongated cylindrical side wall 18, a longitudinal central axis 19, and a pair of axially opposite end walls 20 and 22. Reactants are delivered to the chamber 15 such that products of combustion generated within the chamber 15 will flow axially from the first end wall 20 to the second end wall 22, and further outward through an exhaust port 23 in the second end wall 22. This enables heat to be radiated outward along the length of the side wall 18.

The reactants delivered to the combustion chamber 15 include oxidant and fuel. The oxidant is delivered in a single stage. The fuel is delivered in primary, secondary, and tertiary stages simultaneously with delivery of the oxidant.

A premix burner 40 delivers the oxidant and the primary fuel to the combustion chamber 15. As shown in FIG. 1, the premix burner 40 is located at the first end wall 20 of the radiant heating structure 12, and has a port 41 facing into the chamber 15. The port 41 in this example is centered on the longitudinal central axis 19 of the chamber 15. A plurality of secondary fuel injectors 44 deliver the secondary fuel. The secondary fuel injectors 44, two of which are shown in FIG. 1, are located at the first end wall 20 in an array extending around the longitudinal axis 19. Each secondary fuel injector 44 has a port 45 facing into the chamber 15 along a respective axis 47 that is parallel to the longitudinal axis 19. A fuel injection manifold 50 delivers the tertiary fuel. The fuel injection manifold 50 is centered on the longitudinal axis 19 within the combustion chamber 15 and, in this particular implementation, is closer to the second end wall 22 than the first end wall 20. Tertiary fuel injection ports 51 face radially outward from the manifold 50 along respective axes 53 that are perpendicular to the longitudinal axis 19.

As further shown in FIG. 1, a reactant supply and control system 60 includes lines and valves that convey the reactants to the premix burner 40, the secondary fuel injectors 44, and the fuel injection manifold 50. A fuel source 62, which in this example is a supply of natural gas, and an oxidant source 64, which in this example is an air blower, provide streams of those reactants along respective supply lines 66 and 68.

The oxidant supply line 68 extends directly to the premix burner 40, and has an oxidant control valve 70. A first branch line 72 extends from the fuel supply line 66 to the premix burner 40, and has a primary fuel control valve 74. A second branch line 76 has a secondary fuel control valve 78, and extends from the fuel supply line 66 to a fuel distribution manifold 80. That manifold 80 communicates with the secondary fuel injectors 44 through corresponding fuel distribution lines 82. A third branch line 84 with a tertiary fuel control valve 86 extends from the fuel supply line 66 to the tertiary fuel injection manifold 50.

Figure 2:
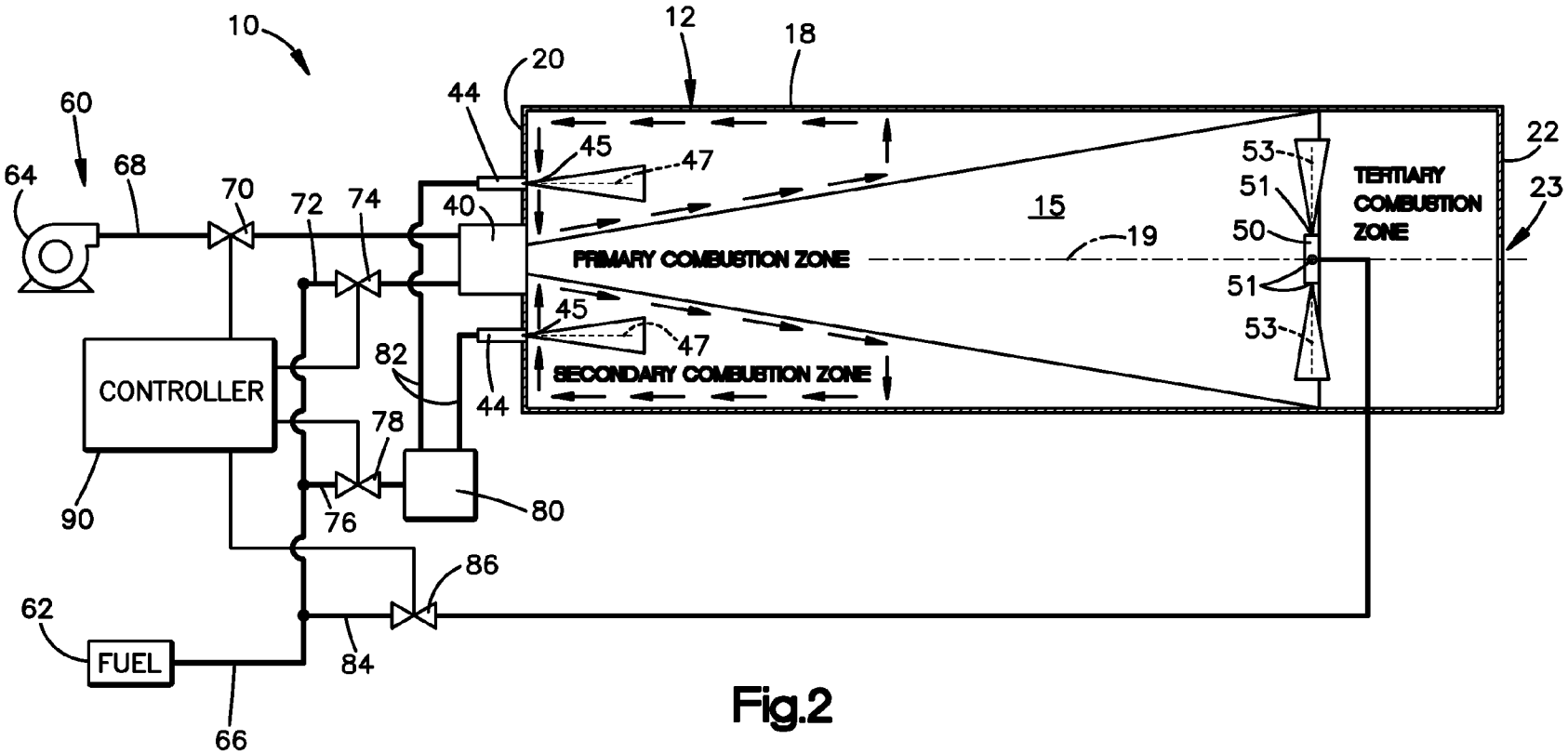
FIG. 2 is a view similar to FIG. 1, schematically illustrating operating conditions within the combustion chamber.

The reactant supply and control system 60 further includes a controller 90 that is operatively associated with the valves 70, 74, 78 and 86 to initiate, regulate and terminate flows of reactants through the valves 70, 74, 78 and 86. Specifically, the controller 90 has combustion controls in the form of hardware and/or software for actuating the valves 70, 74, 78 and 86 in a manner that causes combustion of the reactants to proceed axially downstream through the chamber 15 in generally distinct stages that occur in the generally distinct zones identified in FIG. 2. The controller 90 shown schematically in the drawings may thus comprise any suitable programmable logic controller or other control device, or combination of control devices, that is programmed or otherwise configured to perform as recited in the claims.

In operation, the controller 90 actuates the oxidant control valve 70 and the primary fuel control valve 74 to provide the premix burner 40 with a stream of oxidant and a stream of primary fuel. Those reactant streams mix together inside the premix burner 40 to form premix. The premix is delivered to the combustion chamber 15 as a primary reactant stream directed from the port 41 along the longitudinal central axis 19. Ignition of the premix occurs within the premix burner 40. This causes the primary reactant stream to form a primary combustion zone that expands radially outward as combustion proceeds downstream along the axis 19.

The controller 90 actuates the secondary fuel control valve 78 to provide the secondary fuel injectors 44 with streams of secondary fuel. The secondary fuel streams are injected from the secondary ports 45 which, as described above, are located radially outward of the primary port 41. This causes the unignited streams of secondary fuel to form a combustible mixture with reactants and products of combustion that recirculate in the upstream corner portions of the combustion chamber 15, as indicated by the arrows shown in FIG. 2. Auto-ignition of the combustible mixture creates a secondary combustion zone that surrounds the primary combustion zone at the upstream end portion of the chamber 15, as further shown schematically in FIG. 2.

The controller 90 also actuates the tertiary fuel control valve 86 to provide the downstream manifold 50 with tertiary fuel. The tertiary fuel is delivered to the combustion chamber 15 in streams that are injected from the tertiary ports 51 in directions extending radially outward along the axes 53. The tertiary fuel is thus injected into the combustion chamber 15 at locations within the primary combustion zone. This causes the streams of tertiary fuel to form a combustible mixture with the contents of the primary combustion zone. Auto-ignition of that combustible mixture creates a tertiary combustion zone that extends downstream from the primary zone as combustion in the chamber 15 proceeds downstream toward the second end wall 22.

In addition to providing the generally distinct combustion zones within the combustion chamber 15, the controller 90 can further control the reactant streams in a manner that suppresses the production of NOx. This is accomplished by maintaining fuel-lean combustion throughout the three zones.

For example, the controller 90 can actuate the valves 70, 74, 78 and 86 to deliver fuel and oxidant to the combustion chamber 15 at target rates of delivery that together have a target fuel to oxidant ratio, with the target rate of oxidant being provided entirely in the primary reactant stream, and with the target rate of fuel being provided at first, second and third partial rates in the primary reactant stream, the secondary fuel streams, and the tertiary fuel streams, respectively. Preferably, the first partial target rate of fuel is the highest of the three partial target rates, but is low enough to ensure that the premix, and consequently the primary reactant stream, is fuel-lean. This helps to ensure that combustion in the primary zone is fuel-lean.

The second partial target rate of fuel delivery may be greater than, less than, or equal to the third partial target rate. Suitable values for the first, second and third partial rates could be, for example, 65%, 15%, and 20%, respectively, of the target rate. However, the second partial rate also is preferably low enough to ensure that the resulting combustion is fuel-lean rather than fuel-rich. This helps to avoid the production of NOx that would occur if the secondary fuel were to form a fuel-rich mixture with the relatively low concentration of oxidant in the gasses that recirculate in the secondary zone. Fuel-lean conditions in the secondary zone also help to avoid the high temperature production of NOx that can occur at the interface between the primary and secondary zones when fuel from the secondary zone forms a combustible mixture with oxidant from the primary zone.

The target fuel-to-oxidant ratio is maintained by injecting the tertiary fuel at a third partial rate equal to the balance of the target rate. As the tertiary fuel is injected from the manifold 50, it encounters the fuel-lean conditions in the primary combustion zone. This helps to avoid the fuel-rich and thermal conditions that could increase the production of NOx if the tertiary fuel were injected directly into the secondary combustion zone along with the secondary fuel. The production of NOx is further suppressed by injecting the tertiary fuel streams at locations that are far enough downstream for combustion in the primary zone to have consumed oxidant sufficiently to prevent the formation of fuel-rich conditions upon delivery of the tertiary fuel into the primary zone.

Figure 3:
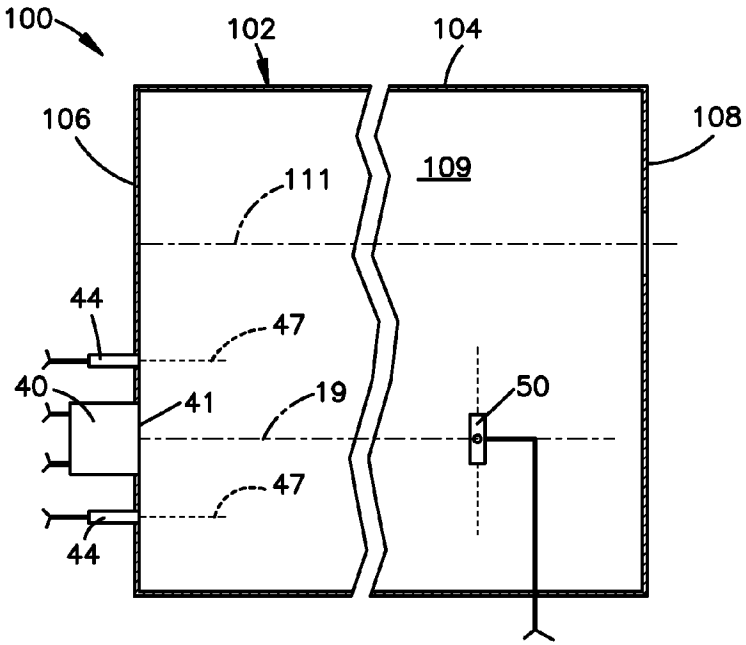
FIG. 3 is a schematic view of an alternative heating system.

An alternative heating system 100 is shown in FIG. 3. The alternative heating system 100 has many parts that are substantially the same as corresponding parts of the heating system 10 described above. Those parts are indicated by the use of the same reference numbers in FIGS. 1 and 3. The heating system 100 of FIG. 3 thus includes a premix burner 40, secondary fuel injectors 44, and a tertiary fuel injection manifold 50. Those parts are operatively interconnected with a reactant supply and control system 60 in the manner described above. However, this heating system 100 differs by including a radiant heating structure 102 that differs from the radiant heating structure 12 described above.

The radiant heating structure 102 of FIG. 3 has an elongated side wall 104 extending longitudinally between a pair of opposite end walls 106 and 108, but the side wall 104 and the enclosed combustion chamber 109 are non-cylindrical and asymmetrical. The combustion chamber 109 thus has a longitudinal central axis 111 extending through the centroids of the end walls 106 and 108. The burner port 41 and the tertiary fuel injection manifold 50 are both centered on an axis 19 that is parallel to, but offset from, the longitudinal central axis 111 of the chamber 109.

Figure 4:
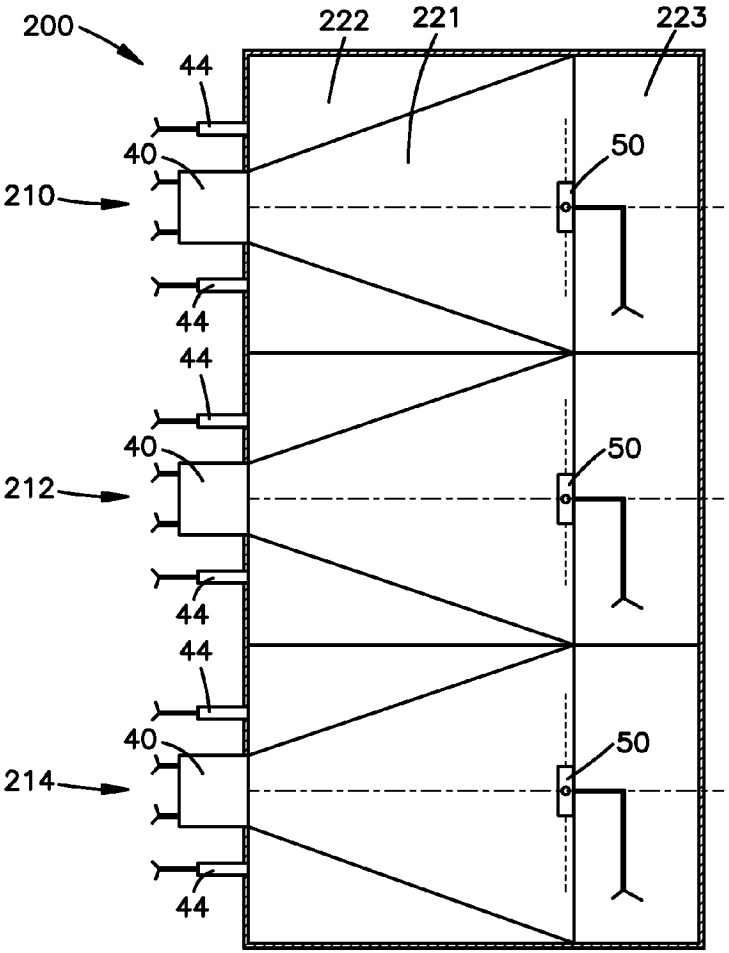
FIG. 4 is a schematic view of another alternative heating system.

Parts of another alternative heating system 200 are shown schematically in FIG. 4. That alternative heating system 200 includes multiple separate arrays 210, 212 and 214 of reactant delivery structures, each of which includes a premix burner 40, secondary fuel injectors 44, and a tertiary fuel injection manifold 50. Each of the multiple arrays 210, 212 and 214 of reactant delivery structures is oriented transversely across an elongated combustion chamber 215, and is operatively interconnected with a reactant supply and control system (not shown) in the same manner as each single array of reactant delivery structures described above. Accordingly, each array 210, 212 and 214 is operative with reference to corresponding primary, secondary and tertiary combustion zones 221, 222 and 223 that extend across the combustion chamber 215 as shown schematically in FIG. 4. The controller for the heating system 200 is preferably configured for each array 210, 212 and 214 to deliver respective target rates of fuel and oxidant that together define a respective fractional portion of an overall combined target rate of reactant delivery. The overall combined target rate of reactant delivery is provided by simultaneous operation of all of the multiple arrays 210, 212 and 214.

This written description sets forth the best mode of carrying out the invention, and describes the invention so as to enable a person skilled in the art to make and use the invention, by presenting examples of elements recited in the claims. The patentable scope of the invention is defined by the claims, and may include other examples that occur to those skilled in the art. Such other examples, which may be available either before or after the application filing date, are intended to be within the scope of the claims if they have structural or method elements that do not differ from the literal language of the claims, or if they have equivalent structural or method elements with insubstantial differences from the literal language of the claims.

The invention claimed is:

1. An apparatus comprising:

a structure defining a combustion chamber;

a burner having a port configured to deliver primary reactants into the combustion chamber to generate primary combustion products that flow downstream through the combustion chamber;

a secondary fuel injector structure configured to inject second stage fuel into the combustion chamber separately from the burner port;

a tertiary fuel injector structure configured to inject third stage fuel into the combustion chamber downstream of the secondary fuel injector structure; and a system configured to deliver fuel and combustion air to the combustion chamber through the burner, the secondary fuel injector structure, and the tertiary fuel injector structure at target rates that together have a target fuel-to-oxidant ratio, while delivering no additional combustion air to the combustion chamber, by:

a) delivering the entire target rate of combustion air and a first partial target rate of fuel to the burner for delivery into the combustion chamber as primary reactants;

b) simultaneously delivering a second partial target rate of fuel to the secondary fuel injector structure for delivery into the combustion chamber as second stage fuel under high temperature conditions that cause the second stage fuel to auto-ignite without requiring a combustion catalyst; and c) simultaneously delivering the balance of the target rate of fuel at a third partial target rate to the tertiary fuel injector structure for delivery into the combustion chamber as third stage fuel under high temperature conditions that cause the third stage fuel to auto-ignite without requiring a combustion catalyst.

2. An apparatus as defined in claim 1 wherein the tertiary fuel injector structure is configured to inject the third stage fuel into the combustion chamber perpendicular to the downstream flow of primary combustion products.

3. An apparatus as defined in claim 1 wherein the combustion chamber has a central axis, and the tertiary fuel injector structure is configured to inject the third stage fuel into the combustion chamber perpendicular to the axis.

4. An apparatus as defined in claim 1 wherein the structure defining the combustion chamber has first and second opposite ends, the burner port is closer to the first end than to the second end, and the tertiary fuel injector structure is closer to the second end than to the first end.

5. An apparatus as defined in claim 1 wherein the system is configured for the second and third partial target rates to be unequal.

6. An apparatus as defined in claim 1 wherein the system is configured to provide the first partial target rate as the highest partial target rate, and to provide the second partial target rate as the lowest partial target rate.

7. An apparatus as defined in claim 1 wherein the system is configured to provide the first partial target rate at about 65% of the target rate, to provide the second partial target rate at about 15% of the target rate, and to provide the third partial target rate at about 20% of the target rate.

8. An apparatus as defined in claim 1 wherein the burner, the secondary fuel injector structure, and the tertiary fuel injector structure together comprise one of a plurality of separate arrays of reactant delivery structures, the target rate of fuel and the target rate of combustion air together define one of a corresponding plurality of fractional portions of an overall combined target rate of reactant delivery, and the system is configured to provide the overall combined target rate by simultaneously and separately performing steps a, b and c at each array of reactant delivery structures for each corresponding fractional portion of the overall combined target rate.

9. An apparatus as defined in claim 8 wherein the system is configured for each second partial target rate to be unequal to the third partial target rate in the respective fractional portion of the overall target rate.

10. An apparatus as defined in claim 8 wherein the system is configured to provide each first partial target rate as the highest partial target rate in the respective fractional portion of the overall target rate, and to provide each second partial target rate as the lowest partial target rate in the respective fractional portion of the overall target rate.

11. An apparatus as defined in claim 8 wherein the system is configured for each first partial target rate to be about 65% of the respective fractional portion of the overall target rate, to provide each second partial target rate as about 15% of the respective fractional portion of the overall target rate, and to provide each third partial target rate as about 20% of the respective fractional portion of the overall target rate.

* * * * *